US009255389B2

(12) United States Patent
Aykens et al.

(10) Patent No.: US 9,255,389 B2
(45) Date of Patent: Feb. 9, 2016

(54) FOOD PREPARATION SINK

(75) Inventors: Steven R. Aykens, Sheboygan Falls, WI (US); Shawn J. Booth, Sheboygan, WI (US); Thomas J. Bostedt, De Pere, WI (US); Jonathan P. Loeck, Neenah, WI (US)

(73) Assignee: KOHLER CO., Kohler, WI (US)

( * ) Notice: Subject to any disclaimer, the term of this patent is extended or adjusted under 35 U.S.C. 154(b) by 1683 days.

(21) Appl. No.: 12/414,744

(22) Filed: Mar. 31, 2009

(65) Prior Publication Data

US 2009/0249541 A1 Oct. 8, 2009

Related U.S. Application Data

(60) Provisional application No. 61/042,818, filed on Apr. 7, 2008.

(51) Int. Cl.

| | |
|---|---|
| ***E03C 1/048*** | (2006.01) |
| ***E03C 1/18*** | (2006.01) |
| ***E03C 1/182*** | (2006.01) |
| ***E03C 1/186*** | (2006.01) |

(52) U.S. Cl.

CPC . *E03C 1/18* (2013.01); *E03C 1/048* (2013.01); *E03C 1/182* (2013.01); *E03C 1/186* (2013.01)

(58) Field of Classification Search

CPC ..... E03C 1/048; E03C 1/18; E03C 1/182; E03C 1/186

USPC ..... 4/619, 650, 671, 620, 311, 515, 629, 4/653; 137/119.04, 587; 241/32.5, 46.01; 472/117; D23/287

See application file for complete search history.

(56) References Cited

U.S. PATENT DOCUMENTS

| | | | | |
|---|---|---|---|---|
| 1,209,555 | A * | 12/1916 | Carlson | 68/233 |
| 1,426,046 | A * | 8/1922 | Jacob | 4/653 |
| 1,468,565 | A | 9/1923 | Guth | |
| 1,947,250 | A | 2/1934 | Davidson et al. | |
| 2,063,243 | A * | 12/1936 | Groeniger | 4/642 |
| 2,197,178 | A * | 4/1940 | Gilbert | 34/569 |
| D155,368 | S * | 9/1949 | Sundberg | D23/287 |
| 2,705,329 | A | 4/1955 | Exton-Porter | |

(Continued)

FOREIGN PATENT DOCUMENTS

| | | |
|---|---|---|
| EP | 1288379 | 3/2003 |
| EP | 1367185 | 12/2003 |

(Continued)

OTHER PUBLICATIONS

A page from a Native Trails web site dated Sep. 28, 2007.

(Continued)

*Primary Examiner* — Ryan Reis
(74) *Attorney, Agent, or Firm* — Foley & Lardner LLP

(57) ABSTRACT

Food preparation sinks are disclosed which have an integral raised work area that is rinsed by an automatic system. Food waste or the like present in that area can be washed into a sump above a drain, and the weight of the waste and water in the sump is enough to automatically drive them through a baffle to a food waste disposer, without requiring the baffle to be manually opened. An automatic controller system coordinates water flow and food waste disposer operation, and the water supply can be linked to the sink below the sink rim to save counter top space. In some forms multiple rinsing nozzles are provided which pulse in altering fashion.

34 Claims, 5 Drawing Sheets

(56) References Cited

U.S. PATENT DOCUMENTS

| | | | | | |
|---|---|---|---|---|---|
| 3,038,172 | A | * | 6/1962 | Fritz et al. | 4/629 |
| 3,163,371 | A | | 12/1964 | Hardy | |
| 3,510,069 | A | * | 5/1970 | Hannum | 241/33 |
| 3,728,745 | A | | 4/1973 | Brendgord et al. | |
| 3,729,750 | A | * | 5/1973 | Giglio | 4/653 |
| D230,402 | S | * | 2/1974 | Graning | D23/287 |
| 3,801,998 | A | | 4/1974 | Macias | |
| D244,291 | S | * | 5/1977 | Baker | D23/293.1 |
| 4,373,676 | A | * | 2/1983 | Sherman, Jr. | 241/36 |
| 4,462,126 | A | * | 7/1984 | Cleaveland | 4/619 |
| 4,624,020 | A | | 11/1986 | Abderhalden et al. | |
| 5,287,570 | A | * | 2/1994 | Peterson et al. | 4/626 |
| 5,308,000 | A | * | 5/1994 | Riley | 241/33 |
| 5,343,574 | A | | 9/1994 | Butte | |
| 5,566,404 | A | | 10/1996 | Laughton | |
| 5,819,335 | A | | 10/1998 | Hennessy | |
| 5,881,754 | A | * | 3/1999 | Wei | 137/119.04 |
| 5,915,851 | A | * | 6/1999 | Wattrick et al. | 4/619 |
| 6,016,579 | A | | 1/2000 | Erbs | |
| 6,353,944 | B1 | * | 3/2002 | Clayton | 4/651 |
| 6,370,705 | B1 | * | 4/2002 | Levinson | 4/301 |
| 6,397,405 | B1 | | 6/2002 | Grech et al. | |
| 6,419,840 | B1 | | 7/2002 | Meincke | |
| 6,446,279 | B1 | | 9/2002 | Lambertson | |
| D494,257 | S | | 8/2004 | Moran et al. | |
| 6,795,987 | B2 | | 9/2004 | Cornwall | |
| 7,201,337 | B1 | * | 4/2007 | Feola | 241/32.5 |
| D560,772 | S | * | 1/2008 | Booth et al. | D23/284 |
| D575,379 | S | * | 8/2008 | Ziemann et al. | D23/284 |
| D588,243 | S | * | 3/2009 | Aykens et al. | D23/287 |
| D602,133 | S | * | 10/2009 | Soulier | D23/284 |
| 2007/0113329 | A1 | | 5/2007 | Luk | |

FOREIGN PATENT DOCUMENTS

| | | |
|---|---|---|
| GB | 348438 | 5/1931 |
| GB | 1293182 | 10/1972 |

OTHER PUBLICATIONS

A page from a Kohler web site ad, undated, admitted prior art, depicting the Bordelaise sink.

12 pages of an excerpt from an Aug. 4, 2009 PCT search report from PCT/US2009/002103, a corresponding PCT application.

Non Final Office Action in U.S. Appl. No. 13/408,773 dated Apr. 16, 2013 (14 pgs).

Non-Final Office Action dated Jun. 15, 2015, 9 pages.

Final Office Action in U.S. Appl. No. 13/408,799 dated May 28, 2014.

* cited by examiner

FOOD PREPARATION SINK

CROSS-REFERENCES TO RELATED APPLICATIONS

Priority is claimed on U.S. provisional application 61/042,818 filed Apr. 7, 2008.

STATEMENT REGARDING FEDERALLY SPONSORED RESEARCH

Not Applicable.

BACKGROUND OF THE INVENTION

The present invention relates to a sink that facilitates the preparation of food and the efficient and hands-free disposal of food waste and other kitchen waste from a sink work area to a food waste disposer (a/k/a garbage disposal).

Various types of preparation steps are typically performed on food items prior to cooking and/or serving. For example, vegetables and fruit may be peeled and/or have seeds, stems or other portions removed from them. The user will typically push the waste portions of the food off a cutting board into a sink by scraping the board with a knife or by hand. The user may then push the waste into the disposal with a tool or other item, sometimes by also using a manually held sprayer to help drive the food towards the drain.

Moving the waste portions in this manner is time consuming and somewhat messy, and the need to push the waste through the disposer entry can require the use of a separate implement to avoid using a hand for that purpose.

Accordingly, there exists a need for addressing these problems.

SUMMARY OF THE INVENTION

In one aspect the invention provides a food preparation sink. The sink has a basin having a lower drain outlet connectable to a food waste disposer, and a bottom surface elevated above the drain outlet. There is also a rim extending around an upper edge of the basin, and a nozzle mounted to the basin below the rim and configured to direct water onto the bottom surface if the nozzle is connected to a water supply. A flange may extend radially outwardly from rim of the basin. If there is food waste in the sink, and if water is directed by the nozzle onto the bottom surface, the sink can be rinsed by the nozzle so as to drive the food waste to an area of the basin above the drain outlet.

The sink provides its own confined, raised work area for cutting/food preparation. The water from the nozzle can rinse the food in this area, and/or carry unneeded waste or scraps to a drain portion of the basin, from which the waste ultimately can go to a food waste disposer. Thus, no separate cutting board is needed (albeit the sink can be used with one), and the food waste can be disposed of more efficiently and, as will be described below, in a hands free/tool free manner.

In a preferred form the bottom surface/work area is an elongated essentially rectangular area that slopes downwardly for a majority of its length. The area may have a concavely sloped entry area (to facilitate smooth flow of entering water and avoiding splashing), and this could transition to a convexly sloped region between the concavely sloped entry area and an area of the basin adjacent the drain outlet (to help food waste move off the work area without getting caught up on it).

In another preferred form the work area terminates at a vertical shoulder that defines in part a sump area over the drain opening. The nozzle is positioned at an end of the work area opposite an end of the work area adjacent the drain opening outlet, and the nozzle directs water essentially along a longitudinal axis of the work area.

In another aspect the food preparation sink may have a basin having a lower drain outlet connectible to a food waste disposer and a work area elevated above the outlet. In this form there are two nozzles mounted to the basin and configured to direct water onto the work area if the nozzles are connected to a water supply. There is a diverter capable of altering (to at least some extent) flow of water between the nozzles if the diverter is linked to a water supply. This altering optimizes the force of the entering water along different portions of the work area, to help optimize the cleaning effect.

This can be implemented with a diverter that has a movable valve member having a first position in which a first flow path is provided between a diverter inlet and a first diverter outlet linked to a first of said nozzles, and a second position in which a second flow path is provided between the diverter inlet and a second diverter outlet linked to a second of said nozzles. For example, in the first position the valve member may also block the second flow path, and wherein in the second position the valve member may also block the first flow path.

In yet another aspect the food preparation sink may have a basin having a lower drain outlet connected to a food waste disposer and a work area elevated above the outlet. In this form there will be a nozzle mounted to the basin and configured to direct water onto the work area if the nozzle is connected to a water supply, and also a conical baffle positioned in the outlet for controlling entry of items into the food waste disposer. If there is food waste in the work area, and if water is directed by the nozzle to the work area, the work area can be rinsed by the nozzle so as to carry the food waste to an area of the basin above the outlet, and weight of the water and food waste can automatically cause the baffle to open to permit the food waste to enter the food waste disposer. This allows the option of completely hands free/tool free operation.

Most preferably, a sump area is provided in the basin above the drain opening that is suitable to develop a head of water and waste above the drain opening so as to facilitate automatic movement of the food waste past the baffle. The sump region is relatively small so that a small amount of water can create an adequate pressure head, and further so that food waste does not get easily hung up on the drain floor remote from the drain.

Other preferred features of the present invention include an electrical controller for controlling the supply of water to the sink and the operation of the food waste disposer. For example, the controller could provide an automatic shut-off of the water and/or food waste disposer after a period of operation.

The sinks of the present invention are particularly useful as food preparation sinks. In the most preferred embodiments, they facilitate the efficient and hands-free movement of food waste from the work area to the food waste disposer. This can be achieved without requiring a faucet mounted on top of the sink or elsewhere on top of the counter, or requiring a hand sprayer. Hence, scarce counter space can be used for other purposes.

The foregoing and other advantages of the present invention will become apparent from the following description. In that description reference will be made to the accompanying drawings which form a part thereof, and in which there is shown by way of illustration example embodiments of the invention. The example embodiments do not limit the full scope of the invention.

DETAILED DESCRIPTION OF THE INVENTION

Figure 1:
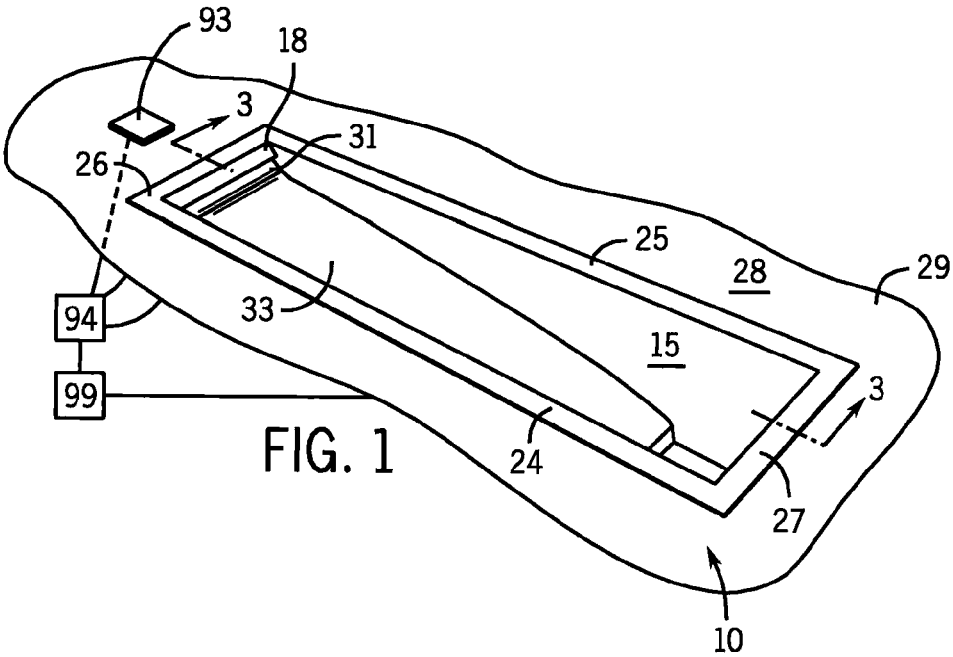
FIG. 1 is a top, frontal, right perspective view of a first embodiment of a food preparation sink according to the invention, mounted on the top of a kitchen counter top in drop-in configuration.
Figure 2:
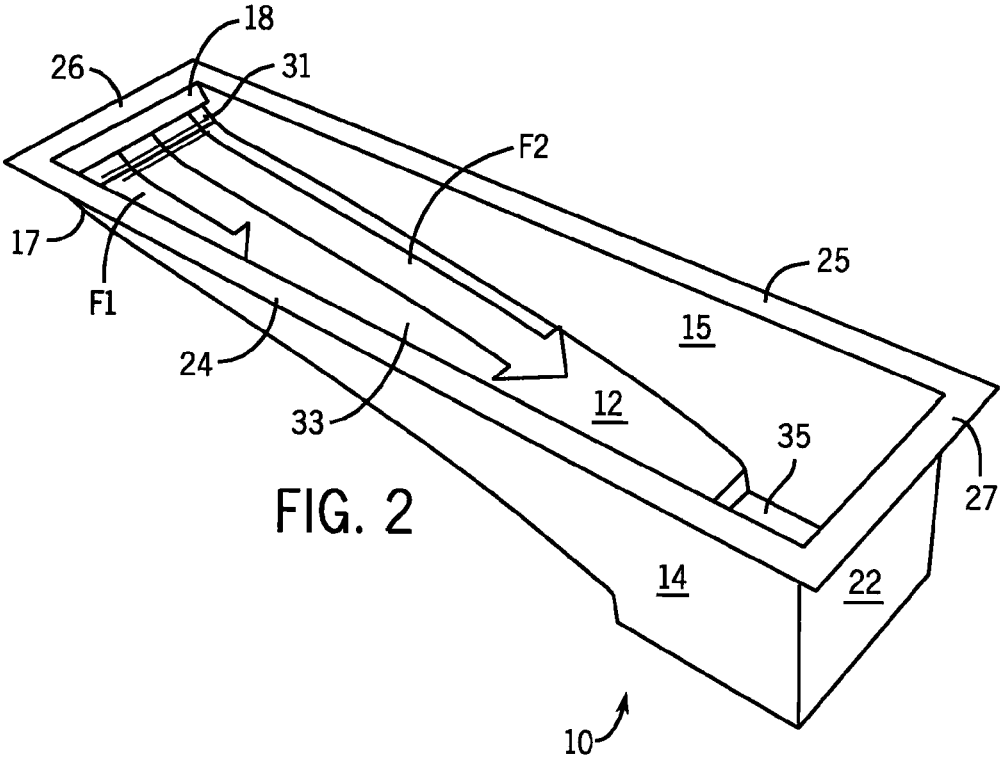
FIG. 2 is a view similar to FIG. 1, but of the sink alone, and depicting water flow paths.
Figure 3:
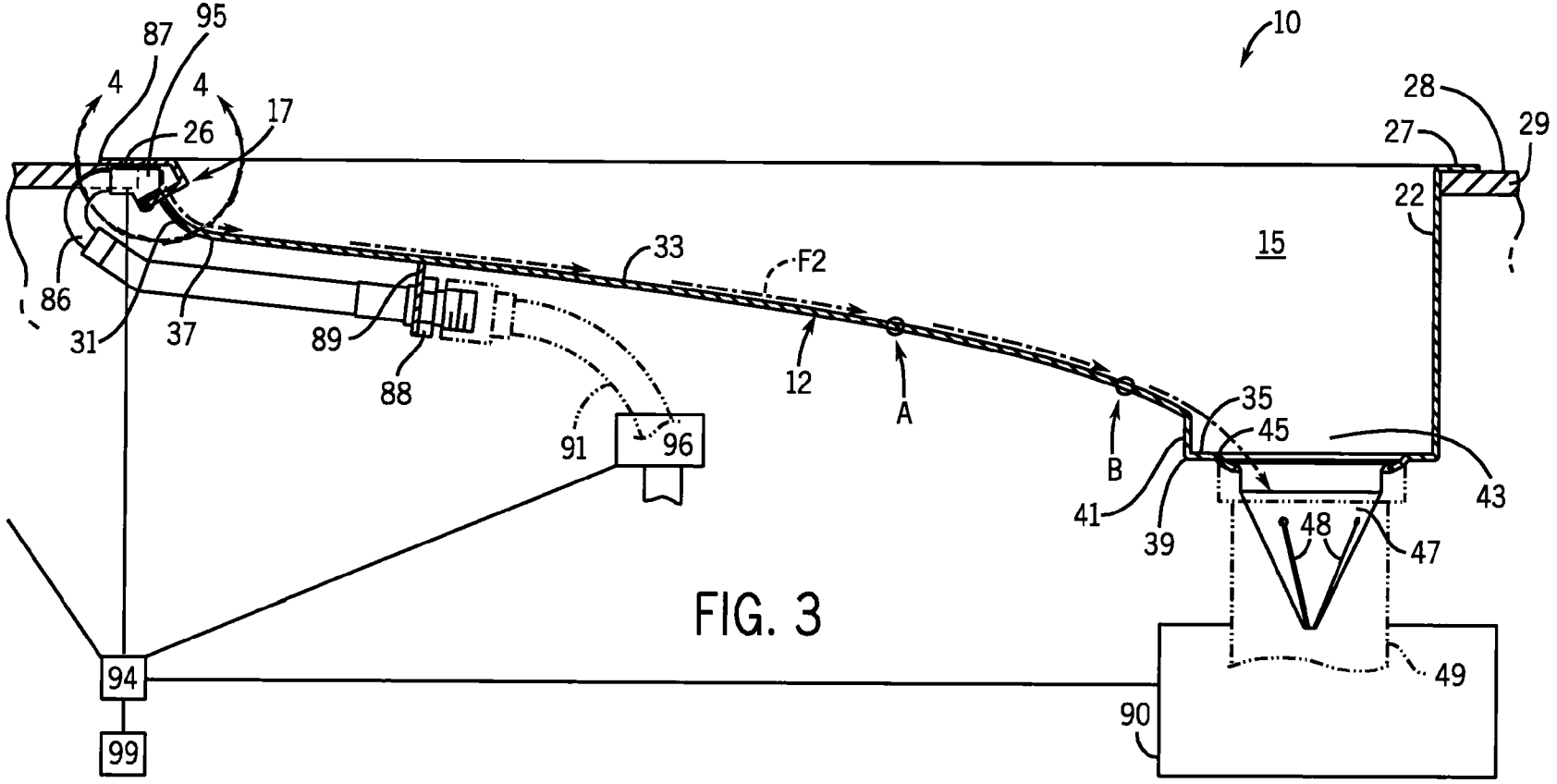
FIG. 3 is a cross-sectional view taken along line 3-3 of FIG. 1.

FIG. 1 illustrates a food preparation sink 10 for preparing food items and disposing of waste. As shown in FIGS. 2 and 3, the sink 10 includes a bottom wall 12, a first side wall 14, a second side wall 15 disposed opposite the first side wall 14, a first end wall 17, and a second end wall 22 disposed opposite the first end wall 17. The first side wall 14, the second side wall 15, the first end wall 17, and the second end wall 22 extend upwardly from the bottom wall 12 to define a basin. One non-limiting example version of the food preparation sink 10 measures about twenty-eight inches (711 millimeters) between the end walls, and about six inches (152 millimeters) between the side walls.

Figure 6:
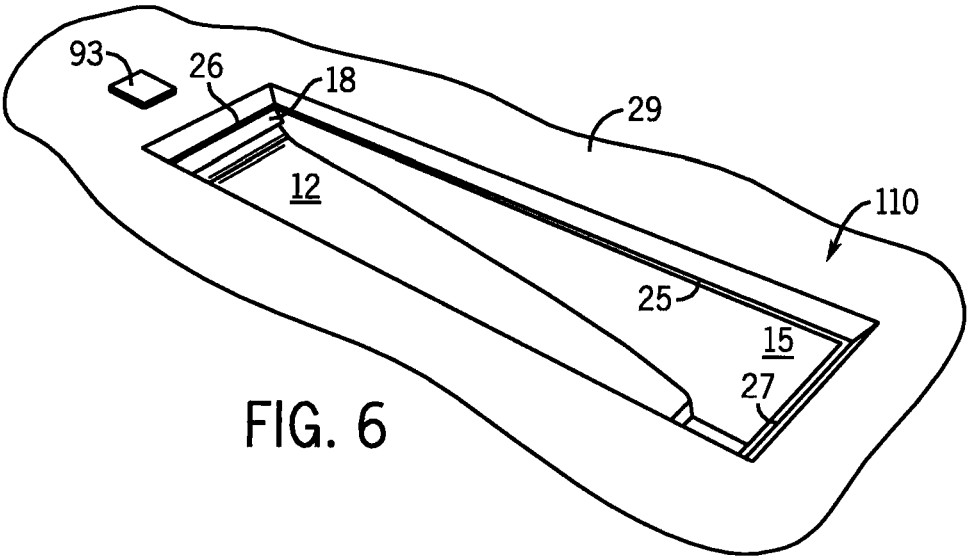
FIG. 6 is a view similar to FIG. 1, but showing the sink mounted in an under counter configuration.

The food preparation sink 10 has a rim extending around an upper edge of the basin. In the construction shown in FIG. 1, flanges 24, 25, 26 and 27 extend radially outwardly from the side walls 14, 15 and end walls 17, 22 at the rim. These flanges 24, 25, 26 and 27 are suitable to sit on a counter surface 28 of a counter top 29 when mounting the food preparation sink 10 in drop-in fashion. As shown in FIG. 6, the flanges can instead facilitate under counter style installation. In addition, the sink may be formed as a continuous one piece construction with the countertop.

The sink is preferably formed from a conventional kitchen sink material such as stainless steel, ceramics, or polymers. In some aspects, and in some constructions, it may be desirable that the material be resistant to nicking or scratching by a cutting knife.

The bottom wall 12 of the food preparation sink 10 slopes downwardly as the bottom wall extends from the first end wall 17 toward the second end wall 22 along the bottom surface of the basin there between. As shown in FIGS. 2 and 3, the bottom wall 12 has a varying non-uniform slope with a concavely sloped region 31 near the first end wall 17, which then transitions into an elongated convexly sloped region 33, and ultimately drops down to a drain floor 35. FIG. 3 illustrates a junction 37 which indicates the transition from the concavely sloped region 31 to the convexly sloped region 33. Junction 39 indicates the transition of the bottom wall 12 between convexly sloped region 33 and floor 35.

A shoulder portion 41 extends vertically downwardly from the convexly sloped region 33 to the drain floor 35. The shoulder portion 41, along with lower portions of the end wall 22 and first and second side walls 14, 15, at least partially define a sump 43 at the bottom of the basin. A drain opening 45 is provided in the drain floor 35 to permit water and waste items to exit the basin. Passage through the drain opening 45 is controlled by a flexible baffle having a conical lower end 47 with vertical slits 48.

The conical lower end 47 covers an entrance passage 49 to a food waste disposer 90 (see the schematic depiction in FIG. 3). Rubber, or another elastomeric material, is particularly well suited for formation of the conical lower end 47. The food waste disposer 90 is preferably a conventional food waste disposer having a motor driving a rotating element to cut waste passing through the drain into smaller pieces.

In one example, the shoulder portion 41 is about one inch (25.4 millimeters) high creating a one inch deep sump 43. Water may accumulate in this sump 43 to create a body of water that provides a pressure difference and helps move waste down into and through the conical lower end 47 without the need for manual assistance to push the waste through. Compared to conventional kitchen sinks, the surface area of the drain floor 35 within the sump 43 is relatively small in relation to the drain opening. This permits even a relatively small amount of water to build up as a significant head within the sump 43, and provides additional pressure beyond that which would be supplied by the same amount of water in a conventional kitchen sink. Also, initiation of the food waste disposer 90 can, depending on the configuration of the food waste disposer, create a slight vacuum that helps suck and thus facilitate entry of the waste.

It is particularly desirable that the slope of the convexly sloped region 33 continuously increases as the waste approaches the drain opening 45. This helps maintain and/or increase the speed of the water flow and move the waste towards the drain floor 35 with sufficient force to stop the waste from getting hung up near the shoulder portion 41. Also, the shoulder portion 41 allows water flowing down the bottom wall 12 to be launched off the convexly sloped region 33 and carry waste toward the drain opening 45.

Figure 4:
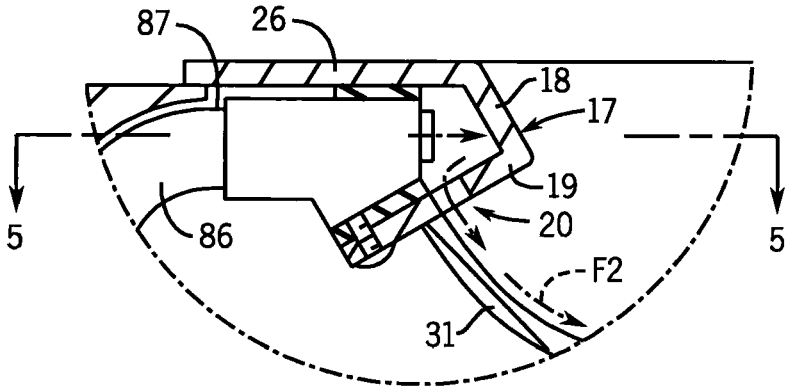
FIG. 4 is a detailed view taken along line 4-4 of FIG. 3.
Figure 5:
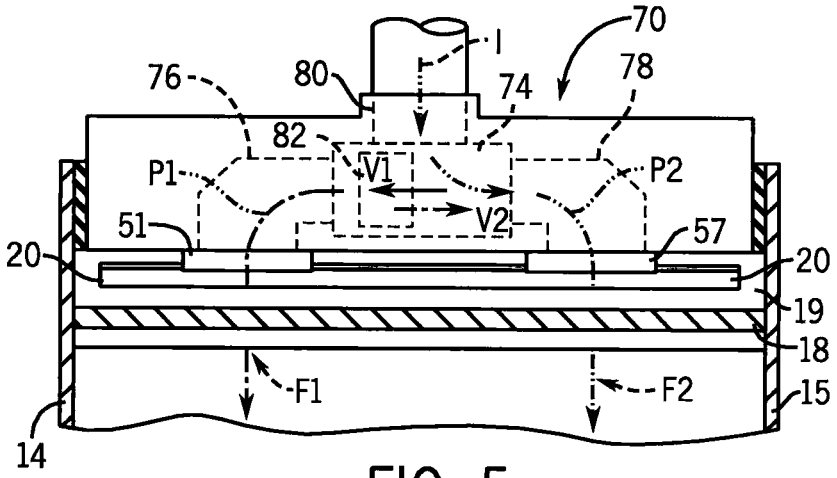
FIG. 5 is a cross-sectional view taken along line 5-5 of FIG. 4.

Referring next to FIGS. 4 and 5, the first end wall 17 includes an upper portion 18 and a lower portion 19 with a rectangular water inlet 20. The food preparation sink 10 has a first nozzle 51 for delivering water in a first flow path F1 along the bottom wall 12 of the food preparation sink 10. The food preparation sink 10 also has a second nozzle 57 for delivering water in a second flow path F2 along the bottom wall 12 of the food preparation sink 10.

Water delivery to the first nozzle 51 and the second nozzle 57 is controlled by a valve system 70 having a manifold 74. The manifold 74 is in fluid communication with a first port 76, a second port 78, and an inlet port 80 and directs fluid flow of the water between these ports 76, 78 and 80. A valve member 82 is positioned in the manifold 74 from controlling water delivery to the first and second nozzles 51, 57 as described below. The valve member 82 preferably has a cylinder driven piston that drives a diverter plate in response to a solenoid. This either turns the water flow on or off to the nozzles 51, 57. Movement of the diverter plate of valve member 82 may be controlled by an actuator 95.

In some aspects and in some constructions, the diverter plate of valve member 82 swings in directions V1 and V2 in the manifold 74 to provide a variable water flow to the nozzles 51, 57. Movement of the diverter plate of the valve member 82 in directions V1 and V2 in the manifold 74 can be controlled by the actuator 95.

The valve system 70 also includes a fitting 86 having a first end 87 that is coupled to the inlet port 80 of the manifold and a second end having a coupler 88. As shown in FIG. 3, a coupler flange 89 attached to the bottom wall 12 can permanently or temporarily retain the coupler 88 to the bottom wall 12. The coupler 88 joins the fitting 86 to a water line 91 from a water source.

Figure 9:
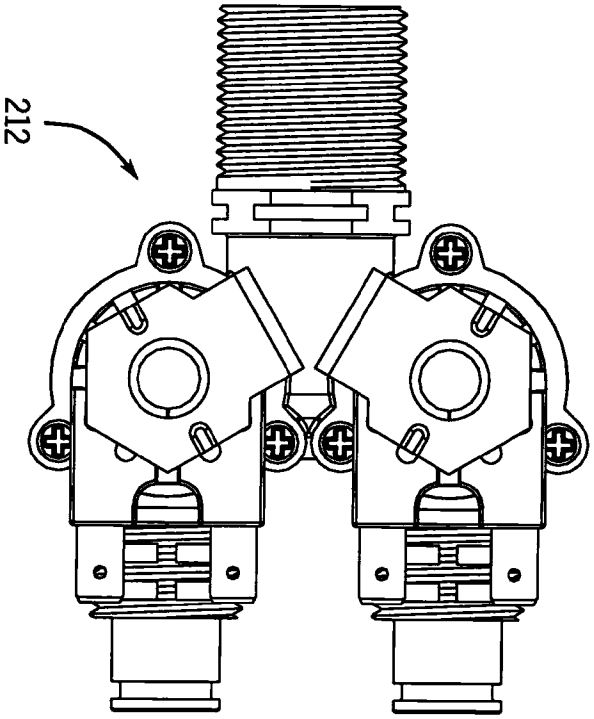
FIG. 9 is an enlarged top view of a valve portion of the FIG. 7 embodiment.

A switch 93 can be actuated by the user to provide a signal to an electronic control module 94. The electronic control module 94 controls introduction of water into the inlet port 80 of the valve system 70 via another solenoid 96 (e.g. a conventional solenoid valve), controls the actuator 95 of the valve system 70 (compare FIGS. 5 and 9) to direct the flow of the water, and controls operation of the food waste disposer 90.

Turning now to FIG. 6, there is shown a under counter mounted food preparation sink 110 according to a second example embodiment of the invention. This is similar to the first embodiment except for using conventional under counter mounting hardware.

Regardless of whether the installation follows the principles of FIG. 1 or FIG. 6, it should be appreciated that no further faucet or hand spray is required to be mounted on the counter top in the preferred embodiments. This saves considerable space.

Having described the primary features of the food preparation sink 10, its preferred operation can be explained as follows. A user pushes on switch 93. This signals the electronic control module 94 to begin delivery of water from water line 91 through fitting 86 and into the inlet port 80 of the valve system 70. This can also signal the food waste disposer 90 to begin operation to dispose of the waste, either immediately or with a slight time delay.

Looking next at FIG. 5, the water flows in direction I into the inlet port 80 and into the manifold 74 of the valve system 70. Depending on the position of the valve member 82, the water takes different flow paths from the manifold 74. The diverter plate of the valve member 82 is movable back-and-forth in a first direction V1 and a second direction V2 to direct the water flow through the valve system 70 between a first path P1 and a second path P2.

When the valve member 82 is in a first position at the end of movement in first direction V1 (as shown in FIG. 5), water generally flows along the second path P2 between the inlet port 80 and the second port 78, and water may be blocked from flowing from the inlet port 80 to the first port 76. Water flowing along the second path P2 through the second port 78 exits the valve system 70 through the second nozzle 57 and enters the basin of the sink 10. Water passing through the second nozzle 57 will generally flow along the second flow path F2 (see FIG. 2) on the bottom wall 12 of the sink 10.

When the valve member 82 is in a second position at the end of movement in the second direction V2, water generally flows along the first path P1 between the inlet port 80 and the first port 76, and water may be blocked from flowing from the inlet port 80 to the second port 78. Water flowing along the first path P1 through the first port 76 exits the valve system 70 through the first nozzle 51 and enters the basin of the sink 10. Water passing through the first nozzle 51 will generally flow along the first flow path F1 (see FIG. 2) on the bottom wall 12 of the sink 10.

The actuator 95 preferably cycles the valve member 82 in directions V1 and V2 in the manifold 74 so that the water varies between the first flow path F1 and the second flow path F2. The varying water flow paths F1 and F2 serve to more efficiently move waste along the bottom wall 12 to the sump 43. As shown in FIG. 2, the water flow paths F1 and F2 are directed longitudinally on the bottom wall 12 in side by side relationship. However, complete coverage from the front side wall 14 to the rear side wall 15 of the upper surface 54 of the bottom wall 12 of the food preparation sink 10 can be provided by each of the water flow paths F1 and F2. The valve member 82 may also be positioned at all points between the directions V1 and V2 to provide a continuously variable water flow in the sink 10 along water flow paths F1 and F2.

In some aspects and in some constructions, the electronic control module 94 is connected to a conventional power outlet box 99 (shown schematically in FIG. 3). The electronic control module 94 (also shown schematically in FIG. 3) preferably has its own power outlet (not shown, in addition to the shown control line to the food waste disposer), and the food waste disposer 90 is plugged into that power outlet (rather than taking up a second linkage at the power outlet box 99). This allows a conventional food waste disposer to be easily connected to the food preparation sink system. It also facilitates the control of the electronic control module 94 relative to activation of the food waste disposer 90 when desired.

The electronic control module 94 may include various settings to control the water flow into the sink 10 and operation of the food waste disposer 90. For example, the electronic control module 94 may receive a signal from the switch 93 to initiate water flow into the sink 10 and then start the food waste disposer 90 after a delay of a set period of time following the water flow. This allows the water to enter the sink 10 and flow down to the sump 43 before the food waste disposer 90 is started. The water flow and the food waste disposer 90 may instead be started simultaneously. In addition, the electronic control module 94 may be set to turn the food waste disposer 90 off after a period of time of operation.

Also, the electronic control module 94 may be configured to sense operation of the food waste disposer 90 to determine when the disposal 90 is finished disposing of the waste. This may be accomplished by sensing output voltage to the food waste disposer 90 (e.g. sensing the RPMs of the food waste disposer 90) or by sensing the turbidity of the water exiting the sink 10, or by other sensing means.

In some embodiments the food preparation sink may have only one nozzle. The pressure of the water from the single nozzle may be spread across the entire bottom wall 21. Instead, a single nozzle may be mounted to oscillate and vary the water flow path along the bottom wall 12. However, by using the pulsing varying flow of a dual nozzle construction shown in FIGS. 2 and 5, the cleaning effects of both pulsation, and having a given pressure need to be spread over only half an area to be cleaned at a time, provide effective movement of waste along the bottom wall 12.

Figure 7:
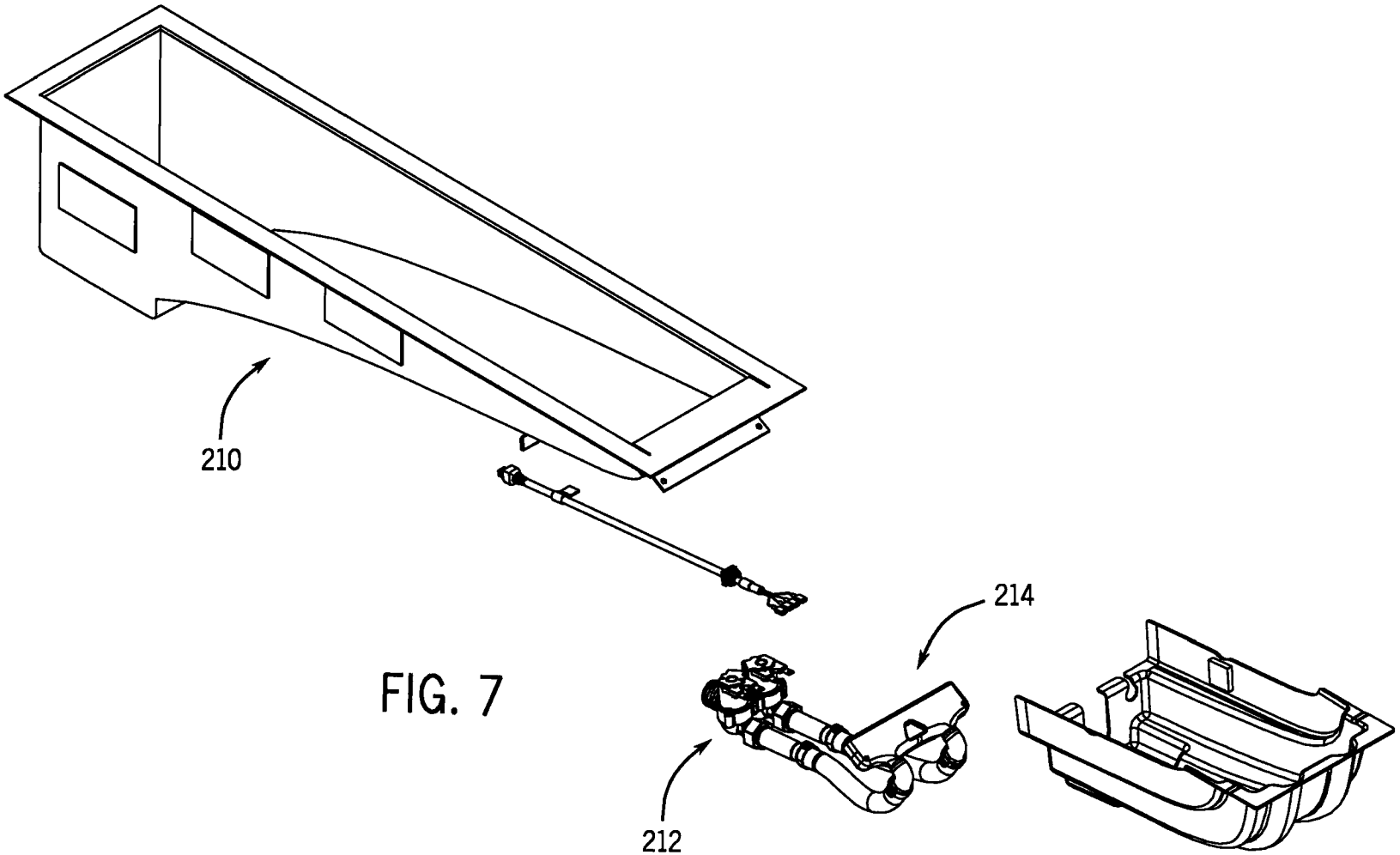
FIG. 7 is an exploded perspective view of a second embodiment of a food preparation sink according to the invention.
Figure 8:
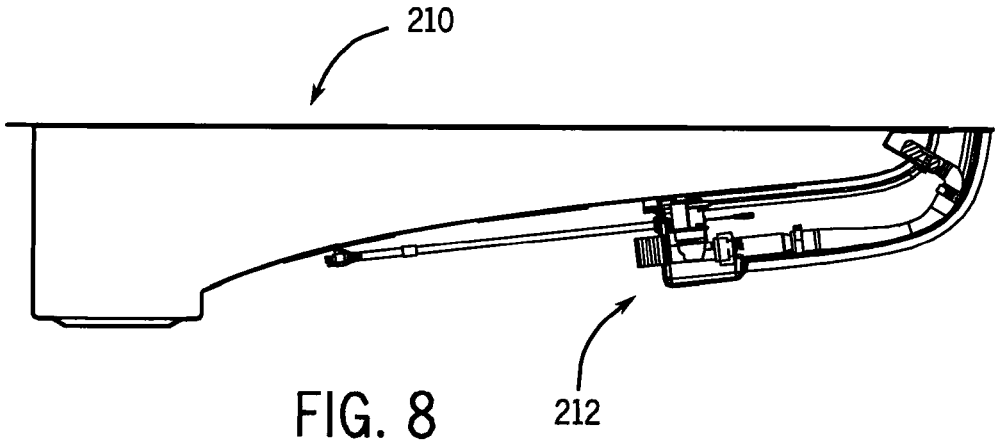
FIG. 8 is a cross-sectional view of the second embodiment in assembled form.

The above description has been that of example embodiments of the present invention. It will occur to those that practice the art, however, that still other modifications may be made without departing from the spirit and scope of the invention. For example, FIGS. 7 and 8 show an alternative sink 210 that uses a valve 212 to split the flow well upstream of a nozzle 214. In this construction the nozzle can direct the water into the basin.

In other embodiments the sink need not be rectangular and the work area/raised bottom wall need not be at a side of the drain area. In this regard, a circular basin could be provided with an outside concentric ring area of the basin being the work area. Hence, the scope of the invention should not be entirely judged by just the example embodiments.

INDUSTRIAL APPLICABILITY

The present invention provides a sink for food preparation or the like that facilitates the efficient and hands-free movement of food waste from the sink basin to the food waste disposer.

We claim:

1. A food preparation sink comprising:

a first end wall;

a second end wall disposed opposite the first end wall;

a bottom wall sloping downwardly while extending from the first end wall toward the second end wall and having a varying slope, the bottom wall including:

a drain floor forming a portion of the bottom wall disposed near the second end wall and having a drain opening within the drain floor allowing water and waste to exit the sink; and a concavely sloped region near the first end wall and a convexly sloped region between the concavely sloped region and the drain floor; and a nozzle mounted adjacent the first end wall and being coupled to a water source to provide a water flow into the sink through the first end wall, the water flow, when present, being configured to follow the contour of the concavely sloped region and the convexly sloped region after exiting the nozzle and being capable of carrying waste within the sink toward the drain opening.

2. The food preparation sink of claim 1, further comprising a baffle disposed within the drain opening and having a conical lower end with vertical wall slits extending along the conical lower end.

3. The food preparation sink of claim 1, further comprising a food waste disposer coupled to the drain opening so as to be suitable to receive water and waste from the drain opening.

4. The food preparation sink of claim 1, further comprising first and second side walls extending between the first and second end walls, and a rim extending around upper edges of the first and second side walls and first and second end walls, the nozzle being disposed below the rim.

5. The food preparation sink of claim 1, wherein the bottom wall has a continuously decreasing slope along the convexly sloped region while extending toward the drain floor.

6. The food preparation sink of claim 1, wherein the bottom wall includes a shoulder portion extending vertically between the convexly sloped region and the drain floor, the shoulder portion at least partially forming a sump allowing water to collect within the sink above the drain floor before passing through the drain opening.

7. A food preparation sink comprising:

a first end wall;

a second end wall disposed opposite the first end wall;

a bottom wall sloping downwardly while extending from the first end wall toward the second end wall, the bottom wall including:

a drain floor forming a portion of the bottom wall disposed near the second end wall and having a drain opening within the drain floor allowing water and waste to exit the sink; and a concavely sloped region near the first end wall and a convexly sloped region between the concavely sloped region and the drain floor; and a first nozzle and a second nozzle mounted adjacent the first end wall and being coupled to a water source to provide a water flow into the sink through the first end wall, the water flow being configured to follow the contour of the concavely sloped region and the convexly sloped region after exiting the nozzle and carry waste within the sink toward the drain opening.

8. The food preparation sink of claim 7, further comprising a valve system including a manifold having an inlet port receiving water flow from the water source, a first port directing water flow from the manifold to the first nozzle, a second port directing water from the manifold to the second nozzle, and a valve member disposed within the manifold and controlling the water flow from the inlet port to at least one of the first and second ports.

9. The food preparation sink of claim 8, wherein the valve system includes an actuator coupled to the valve member and moving the valve member within the manifold to direct the water flow to at least one of the first and second nozzles.

10. The food preparation sink of claim 9, further comprising a food waste disposer coupled to the drain opening so as to be suitable to receive water and waste from the drain opening.

11. The food preparation sink of claim 10, further comprising:

a switch;

an electronic control module coupled to the switch, the valve system, and the food waste disposer, to control operation of the valve system and the food waste disposer in response to receiving a signal from the switch.

12. The food preparation sink of claim 11, wherein the electronic control module actuates the valve system to provide water flow to the sink and then actuates the food waste disposer after a delay of a preset time period following the water flowing into the sink.

13. The food preparation sink of claim 11, wherein the electronic control module controls the actuator to move the valve member to thereby adjust the water flow through the first and second nozzles while water is flowing into the sink.

14. The food preparation sink of claim 7, further comprising a baffle disposed within the drain opening and having a conical lower end with vertical wall slits extending along the conical lower end.

15. The food preparation sink of claim 7, further comprising first and second side walls extending between the first and second end walls and a rim extending around upper edges of the first and second side walls and first and second end walls, the first and second nozzles being disposed below the rim.

16. The food preparation sink of claim 7, wherein the bottom wall has a continuously decreasing slope along the convexly sloped region while extending toward the drain floor.

17. The food preparation sink of claim 7, wherein the bottom wall includes a shoulder portion extending in a generally vertical direction between the convexly sloped region and the drain floor, the shoulder portion at least partially forming a sump allowing water to collect within the sink above the drain floor before passing through the drain opening.

18. A food preparation sink comprising:

a first end wall;

a second end wall disposed opposite the first end wall;

a bottom wall sloping downwardly while extending from the first end wall toward the second end wall, the bottom wall including:

a drain floor forming a portion of the bottom wall disposed near the second end wall and having a drain opening within the drain floor allowing water and waste to exit the sink; and a concavely sloped region near the first end wall and a convexly sloped region between the concavely sloped region and the drain floor;

a baffle disposed within the drain opening and having a conical lower end with vertical wall slits extending along the conical lower end; and a first nozzle and a second nozzle mounted adjacent the first end wall and being coupled to a water source to provide a water flow into the sink through the first end wall, the water flow being configured to follow the contour of the concavely sloped region and the convexly sloped region after exiting the nozzle and carry waste within the sink toward the drain opening.

19. The food preparation sink of claim 18, further comprising a food waste disposer coupled to the drain opening so as to be suitable to receive water and waste from the drain opening.

20. The food preparation sink of claim 18, further comprising first and second side walls extending between the first and second end walls and a rim extending around upper edges of the first and second side walls and first and second end walls, the first and second nozzles being disposed below the rim.

21. The food preparation sink of claim 18, wherein the bottom wall has a continuously decreasing slope along the convexly sloped region while extending toward the drain floor.

22. The food preparation sink of claim 18, wherein the bottom wall includes a shoulder portion extending vertically between the convexly sloped region and the drain floor, the shoulder portion at least partially forming a sump allowing water to collect within the sink above the drain floor before passing through the drain opening.

23. A food preparation sink comprising:

a first end wall;

a second end wall disposed opposite the first end wall;

a drain floor disposed near the second end wall and having a drain opening within the drain floor allowing water and waste to exit the sink;

a bottom wall sloping downwardly while extending from the first end wall toward the second end wall and having a varying slope, the bottom wall including:

a concavely sloped region near the first end wall; and a convexly sloped region disposed between the concavely sloped region and the drain floor;

a shoulder portion extending vertically between the convexly sloped region and the drain floor, the shoulder portion at least partially forming a sump allowing water to collect within the sink above the drain floor before passing through the drain opening;

a baffle disposed within the drain opening and having a conical lower end with vertical wall slits extending along the conical lower end; and a first nozzle and a second nozzle mounted adjacent the first end wall and being coupled to a water source to provide a water flow into the sink through the first end wall, the water flow, if present, being configured to follow the contour of the concavely sloped region and the convexly sloped region after exiting the nozzle and being capable of carrying waste within the sink toward the drain opening.

24. The food preparation sink of claim 23, further comprising a food waste disposer coupled to the drain opening so as to be suitable to receive water and waste from the drain opening.

25. The food preparation sink of claim 23, further comprising first and second side walls extending between the first and second end walls and a rim extending around upper edges of the first and second side walls and first and second end walls, at least one of the first nozzle and the second nozzle being disposed below the rim.

26. The food preparation sink of claim 23, wherein the convexly sloped region has a continuously decreasing slope while extending from the concavely sloped region to a vertical shoulder.

27. The food preparation sink of claim 23, further comprising a valve system including a manifold having an inlet port receiving water flow from the water source, a first port directing water flow from the manifold to the first nozzle, a second port directing water from the manifold to the second nozzle, and a valve member disposed within the manifold and controlling the water flow from the inlet port to at least one of the first and second ports.

28. The food preparation sink of claim 27, wherein the valve system includes an actuator coupled to the valve member suitable to move the valve member within the manifold to direct the water flow to at least one of the first and second nozzles.

29. The food preparation sink of claim 28, further comprising a food waste disposer coupled to the drain opening so as to be suitable to receive water and waste from the drain opening.

30. The food preparation sink of claim 29, further comprising:

a switch; and an electronic control module coupled to the switch, the valve system and the food waste disposer to control operation of the valve system and the food waste disposer in response to receiving a signal from the switch.

31. The food preparation sink of claim 30, wherein the electronic control module actuates the valve system to provide water flow to the sink and then actuates the food waste disposer after a delay of a preset time period following the water flowing into the sink.

32. The food preparation sink of claim 31, wherein the electronic control module controls the actuator to move the valve member adjust the water flow through the first and second nozzles while water is flowing into the sink.

33. The food preparation sink of claim 23, further comprising first and second side walls extending between the first and second end walls and a rim extending around upper edges of the first and second side walls and first and second end walls, the first and second nozzles being disposed below the rim.

34. A food preparation sink comprising:

a first end wall;

a second end wall;

a bottom wall having a drain floor, a concavely sloped region, and a convexly sloped region, the bottom wall sloping downwardly while extending from the first end wall toward the second end wall; and a nozzle configured to produce a water flow configured to follow the contour of the concavely sloped region and convexly sloped region;

wherein the drain floor includes a drain opening and is configured to form a portion of the bottom wall disposed near the second end wall; and wherein the concavely sloped region is disposed near the first end wall and the convexly sloped region is disposed between the concavely sloped region and the drain floor.

* * * * *